US005890784A

United States Patent [19]

Domig

[11] Patent Number: 5,890,784

[45] Date of Patent: Apr. 6, 1999

[54] DRAWER SLIDE

[75] Inventor: Dietmar Domig, Sulz, Austria

[73] Assignee: Alfit Aktiengesellschaft, Götzis, Austria

[21] Appl. No.: 881,785

[22] Filed: Jun. 24, 1997

[30] Foreign Application Priority Data

Jul. 9, 1996 [AT] Austria ..... A 1209/96

[51] Int. Cl.[6] ..... A47B 88/00

[52] U.S. Cl. ..... 312/334.4; 312/330.1

[58] Field of Search ..... 312/334.1, 334.4, 312/350, 257.1, 330.1, 334.8, 334.7, 334.32, 348.2

[56] References Cited

U.S. PATENT DOCUMENTS

| | | | |
|---|---|---|---|
| 1,508,259 | 9/1924 | Stafford | 312/334.4 X |
| 2,594,571 | 4/1952 | Lundberg | 312/334.4 |
| 3,572,874 | 3/1971 | Hassel | 312/350 |
| 3,677,615 | 7/1972 | Hudson | 312/334.4 X |
| 3,716,284 | 2/1973 | Vogt | 312/350 X |
| 3,771,849 | 11/1973 | Barber | 312/350 |
| 5,470,144 | 11/1995 | Wen | 312/330.1 X |
| 5,472,270 | 12/1995 | Czarnecky et al. | 312/330.1 X |

FOREIGN PATENT DOCUMENTS

| | | | |
|---|---|---|---|
| 264052 | 8/1968 | Germany | 312/334.4 |
| 30 42 593 | 6/1982 | Germany . | |
| 3103281 | 8/1982 | Germany | 312/334.4 |

*Primary Examiner*—Peter M. Cuomo
*Assistant Examiner*—James O. Hansen
*Attorney, Agent, or Firm*—Collard & Roe, P.C.

[57] ABSTRACT

In a drawer slide, whose guide rail (1) stationary during usage can be fixed with supporting straps (2) mounted at intervals, clevis or plug connections (7, 13) are provided for the guide rail (1) and the supporting straps (2) to simplify assembly, stockkeeping and packaging, where the guide rail (1) with lugs (13) formed of the rail material can be hung or plugged into recesses (6) formed of the separately mountable supporting straps (2), where at least one connection (6, 13) has a self-locking lift-off or take-off protection (7).

5 Claims, 2 Drawing Sheets

Figure 1:
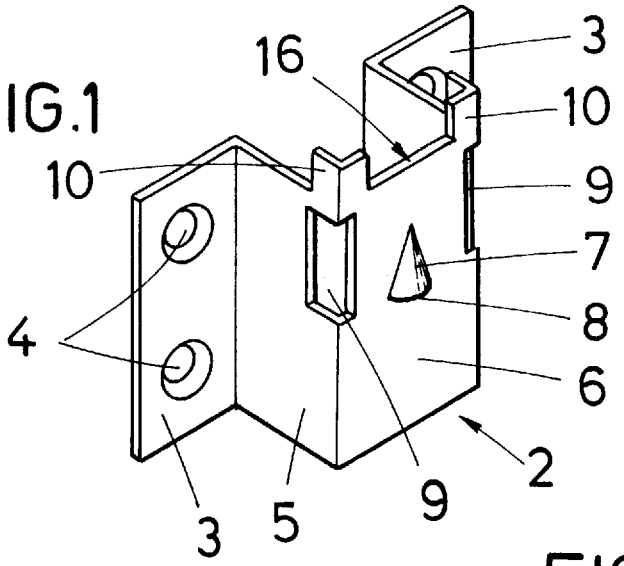

FIG.4
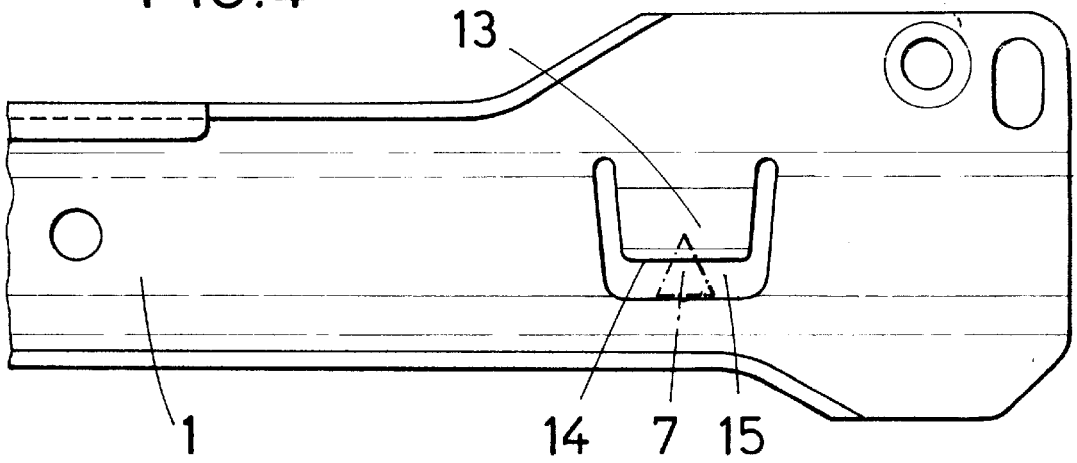
FIG.5
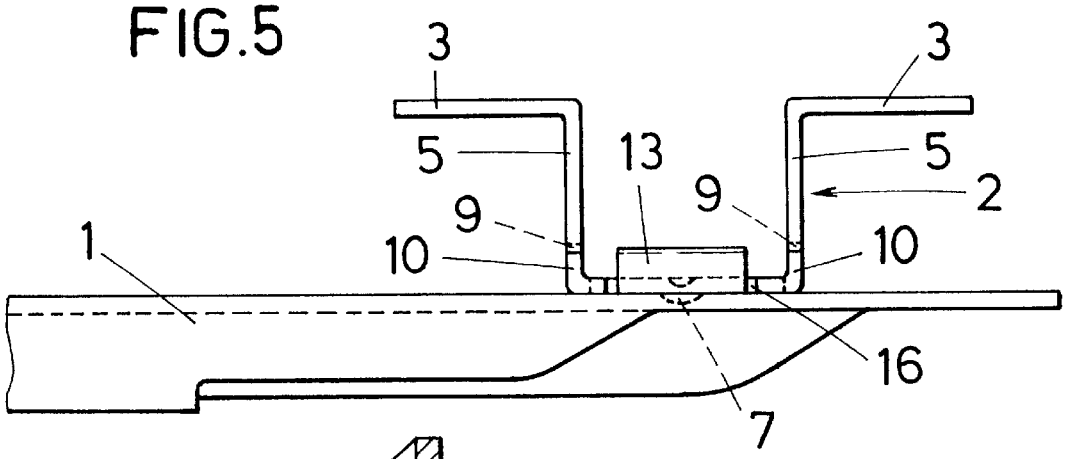
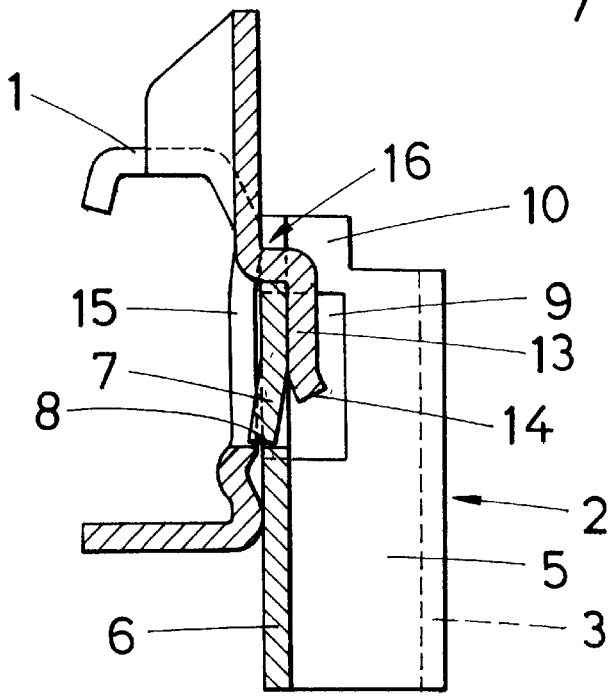
FIG.6

DRAWER SLIDE

This invention relates to a drawer slide whose stationary guide rail is attachable to a wall of a receiving space for a drawer.

Such fastening of the guide rail is chosen when the guide rail should be arranged hidden, e.g. below a lateral frame or if inside a side wall of a drawer below the bottom of the drawer, or the width of the drawer differs from the clear width of the piece of furniture or the like, in which the drawer is going to be used, where the projection of the supporting strap beyond the lateral parts of the piece of furniture compensates for the dimensional deviations, i.e. the various possible mounting widths and side wall distances of the guide rail. Dimensional deviations occur for instance in office furniture, when shutter boxes or drawer chests of desks are built according to a predetermined raster, i.e. with fixed outside dimensions, drawers adapted to the standard paper formats are being used, and plates or other supports of different thickness are used as holders for the drawer slides. In the case of particularly thick wall elements of the stationary piece of furniture, the stationary guide rails can be directly attached to the wall. It has so far been common practice to provide permanent connections, e.g. welded joints, riveted joints or pressure joints, between guide rail and supporting straps. What is disadvantageous is the necessary additional working cycle for making the connection. But what is much more unfavorable is the fact that with different dimensions to be compensated guide rails adapted to these dimensions with readily assembled supporting straps must be used, i.e. a multitude of guide rails with supporting straps of different heights must be kept in store to meet the requirements of orders. The supporting straps protrude beyond the rails and can therefore easily be damaged, and in addition make the drawer slide a bulky component, which requires much space for packaging and shipment. It should also be mentioned that in the case of steel lockers, e.g. from the U.S. Pat. No. 3,771,849 A, it is known to hang guide rails of drawer slides with lugs directly into corresponding holding sections in the sides of the steel locker.

It is the object of the invention to efficiently eliminate the indicated disadvantages of a drawer slide as described above with simple means.

In accordance with the invention, this object is solved by the features of claim 1.

In accordance with the invention the installation of the drawer slide can be simplified, as the guide rail is hung into the supporting straps only subsequently, and these supporting straps can therefore be mounted in the respective furniture with free accessibility, where automatic mounting means can also be used. For compensating different mounting widths, supporting straps of different heights are used, but the drawer slide itself and the guide rail can be chosen independent of this mounting width. If necessary, different materials may be used for the supporting straps and the guide rails, i.e. it is not necessary, as in welded joints, to use materials that are compatible in this respect. Thermal stresses of the rail and the involved risk of a distortion or the occurrence of surface damages are avoided, just as the so far necessary working cycle for making the rigid connection between guide rail and supporting straps. Because of the possible separate packaging of the supporting straps, the packaging of the drawer slides themselves for shipment also becomes easier, and the indicated risk of damaging both the packaging and the workpiece does no longer exist.

In accordance with the invention, various clevis or plug connections, in part known in their basic form, are possible for guide rail and supporting strap. One should always strive to choose as simple forms as possible, and it is in particular desired to design the parts of the plug connection associated with the guide rail such that they can be manufactured as easily as possible in one working cycle.

A particularly simple construction is achieved with an embodiment in accordance with claim 2. By corresponding designs of the embodiment with abutment sides engaging in the opening rim it is possible to produce a rattle-proof connection. With a particularly stiff material it would also be conceivable and possible to mold in the web of the supporting strap a locking tongue set free by indentations at the edge on three sides, and to provide the knob at this tongue protruding to the inside, so that the lug which comes into engagement with the knob when the guide rail is hung in will bend the tongue into the opening of the supporting rail and thus hold the same in a position securing the same against being lifted off.

A fastening possibility particularly facilitating the mounting of the guide rail is given when only two supporting straps per guide rail are necessary. In particular in the case of guide rails close to the ceiling or in the case of narrow and deep pieces of furniture a plug connection as described above for the inner end is easier to make than a clevis connection. In the described embodiment, a clevis connection in the vicinity of the front end of the rail can at the same time be designed as a means for protecting the entire rail against being lifted off and shifted. When in the case of longer drawer slides more than two supporting straps per guide rail are being used, it is nevertheless recommended for the above reasons to possibly use a plug connection for the inner end.

For a reduced stockkeeping there is advantageously chosen an embodiment of the supporting straps in accordance with claim 6, where the type of connection is determined by the arrangement and shape of the lugs of the supporting rail.

Figure 2:
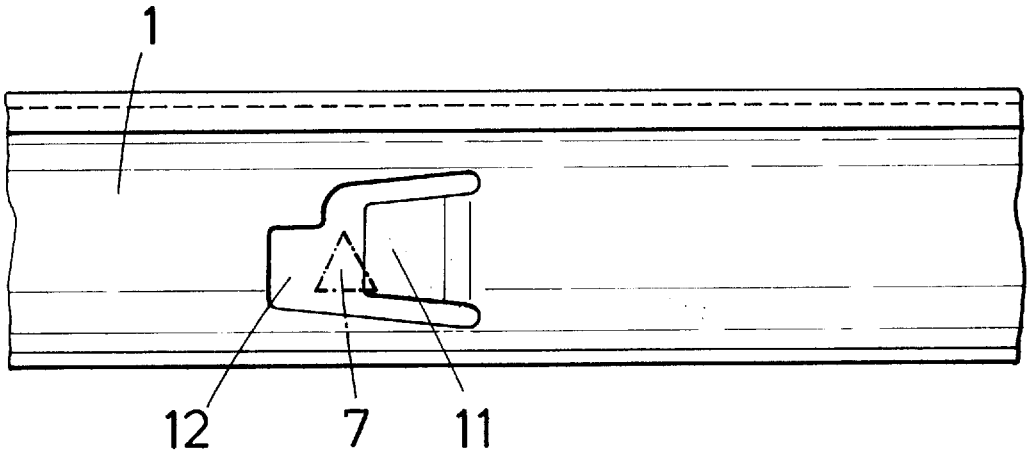
Figure 3:
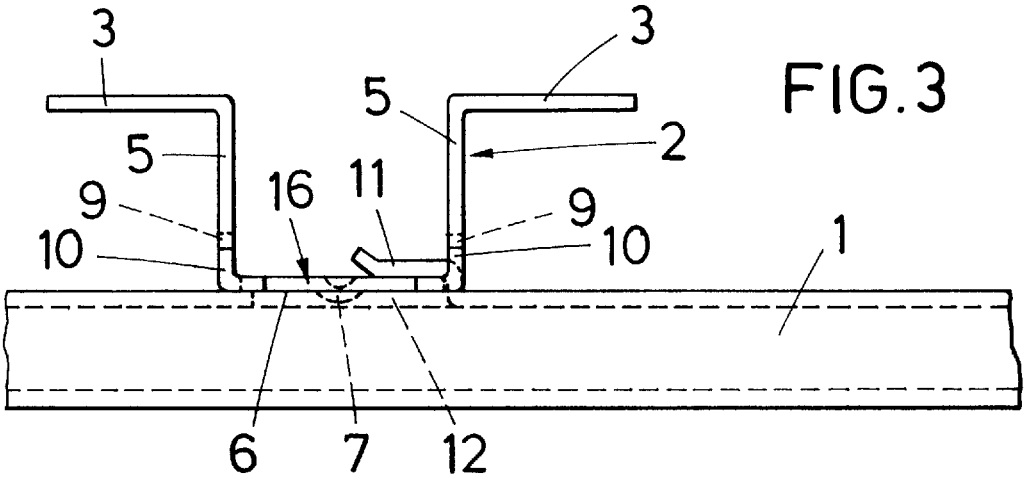

Further details and advantages of the subject-matter of the invention will become more apparent from the subsequent description of the drawing illustrating specific embodiments of the invention by way of example, wherein:

FIG. 1 shows a supporting strap usable both in plug connections and in clevis connections, in a perspective view, FIG. 2 shows a part of a guide rail of a drawer slide in the vicinity of a plug connection, in an inside view, FIG. 3 shows a top view of the rail in accordance with FIG. 2 in the position mounted on a supporting strap, FIG. 4 shows a representation corresponding to FIG. 2 of the front end portion of a guide rail with a lug allowing a plug connection, FIG. 5 shows a top view corresponding to FIG. 3 of the rail in accordance with FIG. 4 fixed on the supporting strap, and FIG. 6 shows a cross-section through supporting strap and guide rail in the mounting position in accordance with FIG. 5 on an enlarged scale.

In the illustrated embodiments, identical supporting straps 2 are being used for fastening a guide rail 1. These supporting straps are simple, basically U-shaped straps with projecting fastening lugs 3 and through-holes 4 for fastening screws. The height of the side legs 5 determines the mounting distance of the guide rail 1 from the side wall or the like of the element in which the drawer slide must be installed. The web 6 serves as abutment against the outside of the guide rail 1 and, in the case of correspondingly profiled guide rails, can be adapted to the cross-sectional profile of this rail. In the middle portion, the web is provided with a protrusion 7 in the form of a triangular knob, whose bottom edge 8 serves as a support for the perforated edge of the rail 1 yet to be described, when it is used in a clevis connection. In the side legs 5 openings 9 are provided which directly lead to the rear side of the web 6. At the web 6, horn-like connecting pieces 10 are formed, between which a locking recess 16 open at the top is formed, and which in addition reinforce the connection of the web with the side legs.

In accordance with FIGS. 2 and 3 a plug connection between the rail 1 and the supporting strap 2 is provided. To make this plug connection possible, projecting lug 11 is formed of the rail material, which overlaps the opening 12 required for its production. For making the plug connection, the lug is simply introduced through one hole 9 in the front side leg of the supporting strap 2. The knob 7 (whose position is indicated in dash-dotted lines in FIG. 2) performs no particular function in this construction. The unused hole 9 in the second side leg 5 of the supporting strap 2 is employed when the second guide rail of the drawer is mounted on the opposite wall.

For making the plug connection represented in FIGS. 4 to 6, the rail 1 comprises a lug 13, whose free end 14 is pointing downwards, and which again is designed for engagement with the inside of the web 6. The opening 15 of the rail 1, which is overlapped by the lug 13, can likewise be seen. When plugging the rail onto the web 6 of the supporting strap 2, the rail and/or the web of the supporting strap is slightly biassed by knob 7, where the lug can also slightly rebound. As soon as the knob reaches the opening 15, it enters into the same, where finally the bottom edge of the opening 15 engages into the downwardly pointing side 8 of the knob 7, so that a lift-off protection is achieved (see also the dash-dotted representation of the knob 7 in FIG. 4). A longitudinal displacement of the rail 1 is likewise impossible due to the engagement of the lug 13 in the locking recess 16.

The shape of the guide rail 1 depends on the drawer slide. In the case of long rails there can also be used three or more supporting straps distributed over the length, and in the case of broad rails the arrangement of the supporting straps and the corresponding lugs in the rail can also be provided with a vertical offset. In all cases, a shape of lug as simple as possible will be desired, so that identical supporting straps can also be used for different guide rails.

I claim:

1. A drawer slide comprising (a) a stationary guide rail having a web attachable to a wall of a receiving space for a drawer, an outside of the guide rail web facing the wall, (b) supporting straps spaced from each other and mounted on the wall for attaching the guide rail thereto in connections each comprising (1) a lug stamped out of the guide rail web and projecting towards the facing wall, the stamped-out lug leaving an underlying opening in the guide rail web and the lug having a free end portion extending substantially parallel to the guide rail web, the free end portion being inserted into a recess of an associated one of the supporting straps and engaging the associated supporting strap at an inside thereof, and (c) at least one of the connections comprising a self-locking safety device preventing detachment of the guide rail from the supporting strap, (1) the self-locking safety device comprising a protrusion on a web of the supporting strap adjacent the outside of the guide rail web, and the protrusion having an abutment engaging an edge of the underlying opening in the guide rail web.

2. A drawer slide comprising (a) a stationary guide rail having a web attachable to a wall of a receiving space for a drawer, an outside of the guide rail web facing the wall, (b) supporting straps spaced from each other and mounted on the wall for attaching the guide rail thereto in connections each comprising (1) a lug stamped out of the guide rail web and projecting towards the facing wall, the stamped-out lug leaving an underlying opening in the guide rail web and the lug having a free end portion extending substantially parallel to the guide rail web, the free end portion being inserted into a recess of an associated one of the supporting straps and engaging the associated supporting strap at an inside thereof, and (c) at least one of the connections comprising a self-locking safety device preventing detachment of the guide rail from the supporting strap, (1) the connection being a clevis connection and the supporting strap having a web adjacent the outside of the guide rail, the supporting strap web extending in a longitudinal direction of the guide rail and defining the recess, the guide rail being hung in the recess, and the free end portion of the lug pointing downwards upon insertion in the recess.

3. A drawer slide comprising (a) a stationary guide rail having a web attachable to a wall of a receiving space for a drawer, an outside of the guide rail web facing the wall, (b) supporting straps spaced from each other and mounted on the wall for attaching the guide rail thereto in connections each comprising (1) a lug stamped out of the guide rail web and projecting towards the facing wall, the stamped-out lug leaving an underlying opening in the guide rail web and the lug having a free end portion extending substantially parallel to the guide rail web, the free end portion being inserted into a recess of an associated one of the supporting straps and engaging the associated supporting strap at an inside thereof, and (c) at least one of the connections comprising a self-locking safety device preventing detachment of the guide rail from the supporting strap, (1) the connection being a plug connection and the supporting strap having a web adjacent the outside of the guide rail and a leg extending from the web to the wall, the leg defining the recess and the free end portion of the lug extending in a longitudinal direction of the guide rail and being inserted in the recess behind the supporting strap web.

4. A drawer slide comprising (a) a stationary guide rail having a web attachable to a wall of a receiving space for a drawer, an outside of the guide rail web facing the wall, (b) supporting straps spaced from each other and mounted on the wall for attaching the guide rail thereto in connections each comprising (1) a lug stamped out of the guide rail web and projecting towards the facing wall, the stamped-out lug leaving an underlying opening in the guide rail web and the lug having a free end portion extending substantially parallel to the guide rail web, the free end portion being inserted into a recess of an associated one of the supporting straps and engaging the associated supporting strap at an inside thereof, and (c) at least one of the connections comprising a self-locking safety device preventing detachment of the guide rail from the supporting strap, (1) the connection for an inner end of the guide rail being a plug connection and the connection for an outer end of the guide rail being a clevis connection whereby the inner guide rail end may first be plugged into and the outer guide rail end may then be hung in the recess of the associated supporting strap.

5. A drawer slide comprising (a) a stationary guide rail having a web attachable to a wall of a receiving space for a drawer, an outside of the guide rail web facing the wall, (b) supporting straps spaced from each other and mounted on the wall for attaching the guide rail thereto in connections each comprising (1) a lug stamped out of the guide rail web and projecting towards the facing wall, the stamped-out lug leaving an underlying opening in the guide rail web and the lug having a free end portion extending substantially parallel to the guide rail web, the free end portion being inserted into a recess of an associated one of the supporting straps and engaging the associated supporting strap at an inside thereof, and (c) at least one of the connections comprising a self-locking safety device preventing detachment of the guide rail from the supporting strap, (1) the supporting strap having a web adjacent the outside of the guide rail and two legs extending from the web to the wall, the legs defining respective ones of the recesses.

* * * * *